US005385075A

United States Patent [19]

Carnes et al.

[11] Patent Number: 5,385,075

[45] Date of Patent: Jan. 31, 1995

[54] PERCUSSION INSTRUMENT

[76] Inventors: Ben Carnes, 5661 Oso Ave., Woodland Hills, Calif. 91367; Alex Neciosup-Acuña, 6934 Wish Ave., Van Nuys, Calif. 91406

[21] Appl. No.: 216,637

[22] Filed: Mar. 22, 1994

[51] Int. Cl.[6] ..... G10D 13/02

[52] U.S. Cl. ..... 84/411 R

[58] Field of Search ..... 84/411 R, 411 P, 419, 84/420

[56] References Cited

U.S. PATENT DOCUMENTS 2,858,724 11/1958 Troppe ..... 84/411 R 4,026,185 5/1977 Migirian ..... 84/411 R

*Primary Examiner*—Michael L. Gellner

*Assistant Examiner*—Patrick J. Stanzione

*Attorney, Agent, or Firm*—Frank L. Zugelter

[57] ABSTRACT

A percussion instrument (10) having a plurality, preferably two (2), of playing heads h1, h2, spaced across from which corresponding apertures 40, 41 are formed in a panel member (20). Side (16, 18), top (12) and bottom (14) panels provide with the playing heads h1, h2 and panel member (20) a closed compartment (25) out of which chambers (32, 34) are formed in corresponding relationship to their heads h1, h2, respectively, by means of an interiorly mounted panel (30).

24 Claims, 2 Drawing Sheets

PERCUSSION INSTRUMENT

TECHNICAL FIELD

This invention is directed to a percussion instrument, and particularly to a percussion musical instrument.

BACKGROUND OF THE INVENTION

One percussion instrument in the musical industry is known as a "cajon",which means a 'box' in the Peruvian language. It is of a hexahedron construction or configuration, made of six (6) wooden rectangularly-configured panels, joined together a right angles to one another, at their edges, all the panels not necessarily being of the same thickness. Its single playing panel, thinner than the others, is in direct and spaced opposition to a same-sized panel that includes a resonating aperture through which sound emanates upon playing of the instrument. The drummer taps, with hand, hands, or chosen numbers of fingers of one or both hands, the playing panel in innumerable ways, throughout its rectangular dimensions, to obtain the pitch and intensity of sound desired.

Various types of instruments are disclosed in the following literature: U.S. Pat. Nos. D100,734; D267,014; D298,951; D321,528; 4,173,917; 4,300,437; 4,457,202; and 4,577,441; however, none of them disclose the instant invention.

SUMMARY OF THE INVENTION

The invention is incorporated within a construction of a percussion instrument that is unique and novel over what has been known and accepted as a "cajon". The invention comprises a plurality of chambers formed within a wooden hollow body, with each chamber having its own playing head formed by a panel and a resonating aperture in a panel generally opposing or in direct opposition to the head. The aperture associated with each chamber is of a size not the same as that of the aperture in the other chamber or chambers. A larger apertures is usually associated with a larger chamber and a smaller one is associated with a smaller chamber, however, the inventive concept embraces the reverse of positions of such apertures in relation to their chambers. The volumetric capacity of either larger or smaller chamber may be generated by a hexahedron configuration of a box, as the inventive concept embraces such a configuration, however, the inventive concept is best illustrated in the embodiment herein. Either the larger or smaller chamber may be formed by a geometric configuration other than that of a hexahedron. Examples of these chambers are illustrated in the drawing FIGURES.

An object of the invention is to provide a unique and novel percussion instrument.

Another object of the invention is to provide a unique and novel musical percussion instrument.

A further object of this invention is to provide a percussion instrument having unique qualities or characters of different sounds or pitches that can emanate from more than one chamber provided in a single instrument.

Still another object of the invention is to provide a percussion instrument that in play is as facile in manipulation as with a conventional drum or the like.

These and other objects and advantages will become apparent by a full and complete reading of the following description, the appended claims thereto and the accompanying drawing comprising two (2) sheets of four (4) FIGURES.

PREFERRED MODE OF CARRYING OUT THE INVENTION

Figure 1:
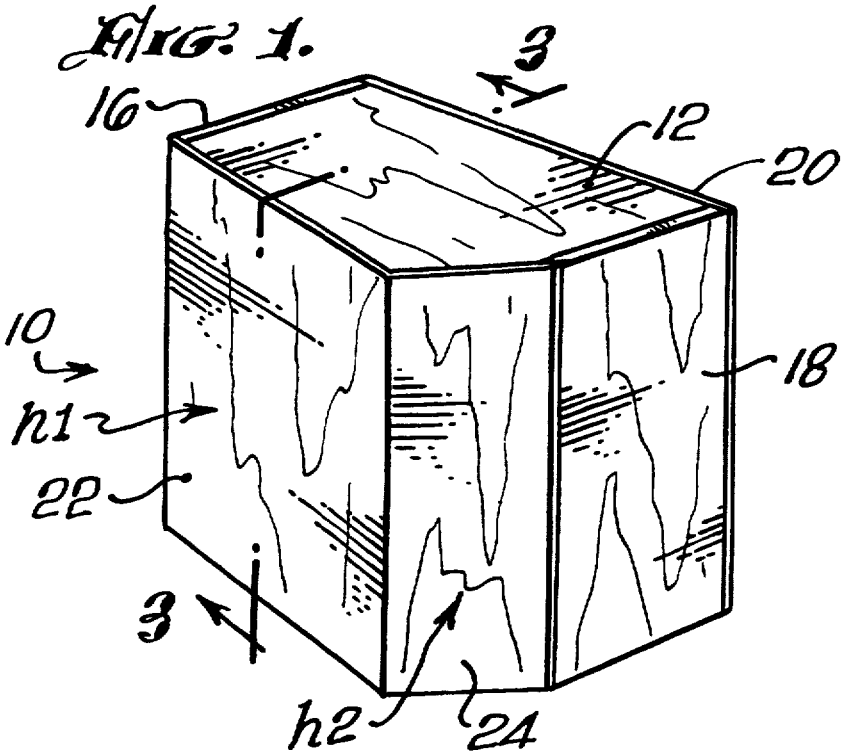
FIG. 1 is a perspective view of the novel instrument.
Figure 4:
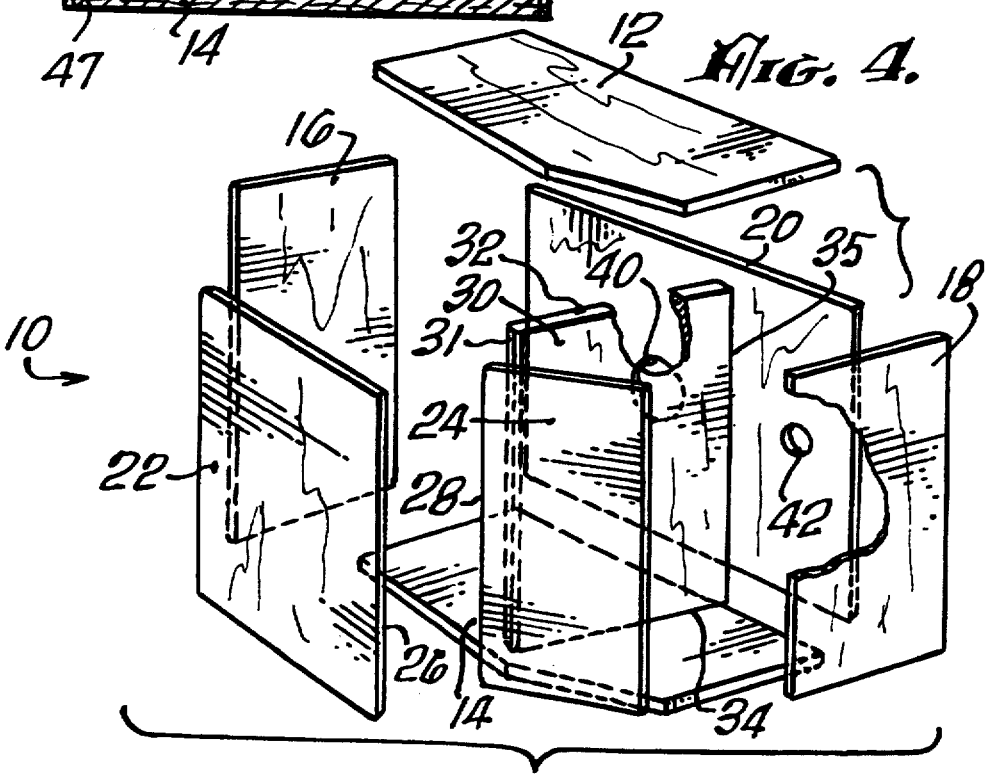
FIG. 4 is an exploded perspective view of the illustrated embodiment of the invention, with one of its elements partially broken away to show a feature in another element.

Referring now to the drawing wherein reference characters therein correspond to like numerals hereinafter, the FIGURES illustrate a preferred embodiment of the invention's percussion instrument 10. Instrument or drum 10 comprises, FIGS. 1, 4, top and bottom panels 12, 14, respectively, side panels 16, 18 joining with the panels 12, 14 along their corresponding adjacent edges, a back or panel member 20 joined together with it the side panels 16, 18 and top and bottom panels 12, 14, at corresponding adjacent edges. These described panels are united at right angles to one another to the extent shown in the illustrations of the FIGURES.

Two (2) playing heads h1, h2, formed from panels 22, 24, respectively, are provided across the space between the side panels 16, 18, in a spaced relationship to and in general confrontation or opposition to the panel member 20, to form a closed or hollow compartment 25 within the instrument 10. Playing panels 22, 24 are joined together, FIG. 4, in a contiguous relation, along their adjacent edges 26, 28, respectively, however, in an angular relationship to one another, as well as an angular relationship to the panel member 20, i.e., other than in a generally parallel relationship to panel member 20. An interior panel 30 includes one vertically-oriented edge 31 to and on which the panels 22, 24 are joined, the interior panel 30 itself extending rearwardly therefrom, its top and bottom edges 32, 34 physically joining the top and bottom panels 12, 14, respectively, while its other vertically-oriented edge 35 is suitably attached to the panel member 20, thereby forming two separate (2) chambers 36, 38 out of the compartment 25. In the preferred embodiment of the interior panel 30 is generally parallel to side panels 16, 18 which in turn are parallel to one another.

Figure 2:
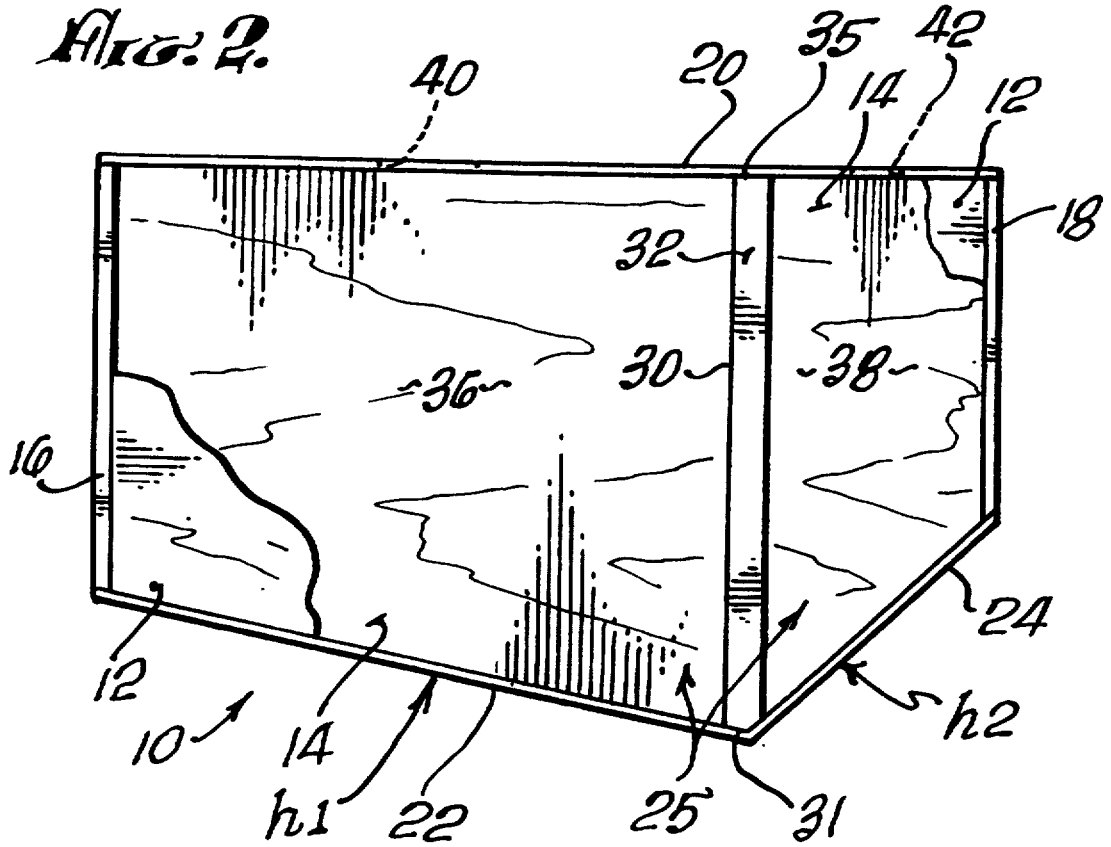
FIG. 2 is a top plan view of the instrument in FIG. 1, with the top partially broken away.

The width of panel 22 between side panel 16 and the interior panel 30 is longer than the width of the panel 24 between the interior panel 30 and side panel 18. The width of the interior panel 30 between its edges 31, 35 is greater than the widths either of the two side panels 16, 18, while the widths of the side panels 16, 18 themselves are not of the same measurement, FIGS. 1, 2 and 4. Consequently, chamber 36 between side panel 16 and interior panel 30 is of a greater capacity for resonating sound that the resonating capacity of chamber 38 between interior panel 30 and side panel 18.

Apertures 40, 42 are formed in different portions of the panel member 20, the aperture 40 being disposed in the portion of panel member 20 corresponding to chamber 36, and the aperture 42 being disposed in the portion of the panel member 20 corresponding to the chamber 38. Correspondingly, apertures 40 is larger than aperture 42, since it corresponds to a larger chamber 36 than does aperture 42 to its chamber 38. Likewise, aperture 42 is smaller than aperture 40, since it corresponds to a smaller chamber 38 than does aperture 40 to its chamber 36. Each of these apertures are disposed generally midway and centrally of the length and width of the panel member 20, however, it should be understood that the respective positions of the apertures 40, 42 in panel member 20 are not limited to their illustrations shown in the FIGURES, and may be positioned elsewhere as well as being independently positioned from one another.

Figure 3:
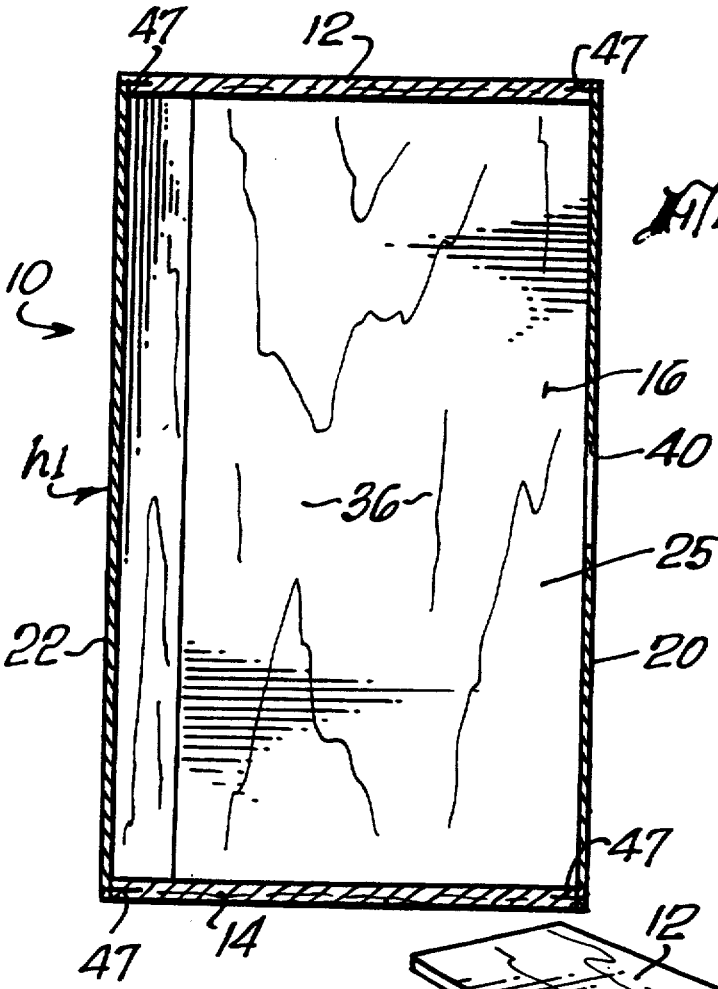
FIG. 3 is a view taken on line 3—3 of FIG. 1.

In construction of the instruemnt 10, the thickness of the playing panels 22, 24 and that of the panel member 20 is preferably ¼", with the material being plywood. The side panels 16, 18 are fabricated preferably from ½" plywood, while the interior panel 30 is fabricated preferably from ¾" plywood. All of these panels or members are correspondingly joined together along their edges, as shown in the FIGURES, and secured thereto by means of suitable wood glue, or by staples 47, examples of this being shown in FIG. 3. The height of instrument 10 is twenty (20") inches and the panel member 20 measures twenty (20") inches between the side panels 16, 18. Interior panel 30 measures thirteen (13") inches between the panel member 20 and its joining to the playing heads h1, h2.

In playing, the drummer (not shown) rests the instrument 10 comfortably, say, between his legs while being seated or standing, while tilting the instrument 10 to a degree and inclination by which his fingers caress the playing surface of one or both of the playing heads h1, h2. The playing heads h1, h2 are exposed outwardly, say, towards an audience of listeners, so that the fingers and/or hands of the drummer are free to run over the surface or surfaces of either or both of such playing heads h1, h2, to seek out the sound desired, the force and its application at a particular location of the fingers and/or hands on the playing heads h1, h2 determining the intensity and pitch of such sound. A 'ring' rather than a 'slapping' sound is sought in the playing of the instrument 10.

In assembly, after each of the panels of instrument 10 has been sized in its fabrication from plywood, in the dimensions (length, width and thickness) pointed out above, or to other desired dimensions, they are joined together and secured together as described above, by suitable wood glue and/or staples 47. Cosmetic finish in terms of providing a layer or layers of attractive coating may be applied should it be desired, to enhance the appearance of the instrument 10.

Various changes and modifications may be made without departing from the spirit and scope of the invention. Wood different from plywood and other suitable materials may be utilized for fabricating the panels in the making of instrument 10. The sizes, configurations, and panel locations of apertures 40, 42 may be changed, as well as the dimensions of the panels forming the instrument 10. The angle between the heads h1, h2, at the interior panel 30, may approach and reach 180°, however, it should be understood that the scope of the invention, in such instance, embraces two (2) separate panels 22, 24 in the fabrication of the playing heads h1, h2, respectively, rather than they being fabricated from a single panel member. Otherwise, the character of sound of one feeds into the other thereby detrimentally affecting the quality or resonance of sound being sought from one or another of the chambers. The widths of the heads h1, h2 may approach equality, but only where the two (2) chambers 36, 38 and/or the two (2) resonating apertures 40, 42 were not to be of the same size. The width of the interior panel 30 may be of a length less than that shown in FIG. 2, including being less than panel 18. Nor is the number of chambers limited to but two chambers. A larger sized aperture may be formed in the portion of the panel member 20 corresponding to a smaller chamber, with the smaller aperture being formed in the portion of the panel member 20 forming a larger chamber. The apertures may also be of equal size as well, for both chambers. There may be more than one aperture in a portion of the panel member 20 for a corresponding playing head and its chamber. The panel member 20 may be fabricated from more than a singe member.

INDUSTRIAL APPLICABILITY

The invention is most useful in the musical industry and yet also capable of providing signals in the communications industry.

We claim:

1. A percussion instrument formed by panels joined together to generate a compartment and comprising:
   - at least two playing heads in contiguous relation to each other in the instrument but not necessarily in planar relation to one another,
   - a panel member having a plurality of apertures, said panel member is generally opposing and spaced relationship to said playing heads, and
   - one or more interiorly mounted panels in said compartment as required to form a plurality of resonating chambers that correspond to the number of said playing heads in said instrument,
   - each of said playing heads and its corresponding one of said chambers having at least one of said apertures formed in a portion of said panel member to correspond therewith.

2. The percussion instrument of claim 1 wherein the apertures are not of the same size.

3. The percussion instrument of claim 1 wherein the playing heads are not of the same size.

4. The percussion instrument of claim 1 wherein the chambers are not of the same size.

5. The percussion instrument of claim 1 wherein respectively the apertures, the playing heads, and the chambers are not of the same size.

6. The percussion instrument of claim 5 wherein one of the apertures in one portion of the panel member corresponding to one of the playing heads that is larger than one of the other playing heads is larger in size than one of the apertures in another portion of the panel member corresponding to one of the other playing heads.

7. The percussion instrument of claim 5 wherein one of the apertures in one portion of the panel member corresponding to one of the playing heads that is smaller than one of the other playing heads is larger in size than one of the apertures in another portion of the panel member corresponding to one of the other playing heads.

8. The percussion instrument of claim 1 or claim 2 or claim 3 or claim 4 or claim 5 or claim 6 or claim 7 wherein the panels joined together include a pair of side panels and at least one of said interiorly mounted panels is of a dimension greater than that of either of said side panels.

9. The instrument of claim 1 or claim 2 wherein the larger and smaller sizes of the apertures in the panel member correspond to their corresponding larger and smaller playing heads.

10. A percussion instrument comprising panels, including side panels, joined together to generate a closed compartment, two playing heads in contiguous relation to each other in the instrument but not necessarily in planar relation to one another, a panel member having a pair of apertures each in its own portion of said panel member corresponding to its one of said two playing heads, said panel member in generally opposing and spaced relationship to said playing heads, and an interiorly mounted panel forming a pair of resonating chambers in said compartment for corresponding ones of said playing heads and their apertures.

11. The percussion instrument of claim 10 wherein one of the two resonating chambers is larger than the other of said resonating chambers.

12. The percussion instrument of claim 10 or claim 11 wherein said interiorly mounted panel is of a measurement greater than that of either of said side panels.

13. The percussion instrument of claim 10 or claim 11 wherein one of said apertures is larger than the other of said apertures.

14. The percussion instrument of claim 13 wherein said interiorly mounted panel is of a measurement greater than that of either of said side panels.

15. The percussion instrument of claim 13 wherein the larger one of the apertures is in the portion of the panel member corresponding to the larger of said resonating chambers.

16. The percussion instrument of claim 15 wherein the larger one of the apertures is in the portion of the panel member corresponding to the smaller of said resonating chambers.

17. The percussion instrument of claim 15 wherein said interiorly mounted panel is of a measurement greater than that of either of said side panels.

18. The percussion instrument of claim 10 or claim 11 wherein one of said apertures is smaller than the other of said apertures.

19. The percussion instrument of claim 18 wherein said interiorly mounted panel is of a measurement greater than that of either of said side panels.

20. The percussion instrument of claim 18 wherein the smaller one of said apertures is in the portion of the panel member corresponding to the smaller of said resonating chambers.

21. The percussion instrument of claim 18 wherein the smaller one of said apertures is in the portion of the panel member corresponding to the larger of said resonating chambers.

22. The percussion instrument of claim 20 wherein said interiorly mounted panel is of a measurement greater than that of either of said side panels.

23. The percussion instrument of claim 16 wherein said interiorly mounted panel is of a measurement greater than that of either of said side panels.

24. The percussion instrument of claim 21 wherein said interiorly mounted panel is of a measurement greater than that of either of said side panels.

* * * * *

UNITED STATES PATENT AND TRADEMARK OFFICE

CERTIFICATE OF CORRECTION

PATENT NO. : 5,385,075

DATED : January 31, 1995

INVENTOR(S) : Carnes, Ben and Neciosup-Acuna, Alex

It is certified that error appears in the above-identified patent and that said Letters Patent is hereby corrected as shown below:

In column 4, line 28, read "is" as - -in - - .

In column 4, line 57, read "larger" as - - smaller - - .

Signed and Sealed this

Sixteenth Day of May, 1995

*Attest:*

Bruce Lehman

BRUCE LEHMAN

*Attesting Officer*

*Commissioner of Patents and Trademarks*